United States Patent [19]

Malizard et al.

[11] Patent Number: 4,883,412

[45] Date of Patent: Nov. 28, 1989

[54] VARIABLE CAPACITY DIAPHRAGM PUMPS

[75] Inventors: Max A. Malizard, Saint Remy L'Honore; Jean C. Degremont, Vascoeuil, both of France

[73] Assignee: Dosapro Milton Roy, Pont-Saint-Pierre, France

[21] Appl. No.: 77,983

[22] Filed: Jul. 27, 1987

Related U.S. Application Data

[63] Continuation of Ser. No. 873,474, Jun. 11, 1986, abandoned, which is a continuation of Ser. No. 689,794, Jan. 8, 1985, abandoned.

[30] Foreign Application Priority Data

Jan. 11, 1984 [FR] France ..... 84 00343

[51] Int. Cl.[4] ..... F04B 43/06

[52] U.S. Cl. ..... 417/387; 92/13.5

[58] Field of Search ..... 417/383, 385, 386, 387, 417/388, 499, 389; 74/55; 92/13.5, 13.51, 74, 129

[56] References Cited

U.S. PATENT DOCUMENTS

| | | | |
|---|---|---|---|
| 1,050,528 | 1/1913 | Elvin | 92/74 X |
| 2,450,912 | 10/1948 | Putnam | 74/55 |
| 3,216,355 | 11/1965 | Wanner | 74/55 |
| 3,312,171 | 4/1967 | Cary | 417/386 X |
| 3,910,727 | 10/1975 | Flynn et al. | 417/387 |

*Primary Examiner*—Leonard E. Smith

*Attorney, Agent, or Firm*—Woodcock Washburn Kurtz Mackiewicz & Norris

[57] ABSTRACT

The invention relates to an improvement in variable capacity diaphragm pumps. According to the invention, the piston is driven by a cam fast with the wheel of a speed reducing gear pair, the eccentric/wheel assembly rotating idly on a fixzed shaft of which the axis is perpendicular to the axis of the piston, the piston terminating in a U-shaped shank of which the wings are perpendicular to the axis of the piston and spaced apart by a length slightly greater than the diameter of the eccentric, and of which the base is perpendicular to said fixed shaft and is provided with a longitudinal groove parallel to the axis of the piston which is traversed by the fixed shaft, the eccentric being housed between the wings of the shank. The invention is more particularly applicable to the manufacture of diaphagm pumps.

1 Claim, 2 Drawing Sheets

II
II
-5-
-29-
1
2
3
4
4a
4b
6
7
8
9
10
11
12
13
14
15
16
17
18
19
20
21
22
23
24
25
26
27
28
30
31
32
33
34
35
36
37
38
39
40
41
42
43
44
45
46
47
50

VARIABLE CAPACITY DIAPHRAGM PUMPS

This is a continuation of application Ser. No. 873,474, filed June 11, 1986, abandoned, which is a continuation of application Ser. No. 689,794, filed Jan. 8, 1985, abandoned.

The invention relates to an improvement in variable capacity diaphragm pumps, concerning more particularly means for driving and guiding the fixed stroke piston for hydraulically actuating the diaphragm. Various variable capacity diaphragm pump systems are known in their principle, in which the diaphragm limiting the pumping chamber is actuated hydraulically by a liquid contained in a second, so-called displacement chamber in which a piston animated by a reciprocating movement with fixed stroke moves. The variation in flow rate is thus obtained by a device for discharging part of the liquid contained in the displacement chamber during a variable part of the stroke. More particularly, this device may be constituted by a hollow piston provided in the vicinity of the back end with radial orifices shut off by an outer ring during part of the stroke and opening into a reserve chamber at atmospheric pressure during another part of this stroke. By adjusting the axial position of the outer ring, the portion of the stroke, called "active stroke" during which the orifices are shut off, and consequently the flow rate of the pump, are varied.

The contruction of this pump system is considerably simplified and of lower cost price with respect to hydraulically controlled diaphram pumps with variable stroke or rate of the piston. Nevertheless, this system presents a major drawback.

Due to the presence, to the rear of the piston, of the adjustable mechanism for shutting off the holes, the longitudinal dimensions are increased, as well as the overhang in the case of conventional drive systems of the connecting rod/crank or cam/spring return type, limited for well known reasons to low powers. This increase in the overhang involves either a risk of premature wear of the piston, or a considerable extension of the front guiding of the piston, which leads to an increase in the price, weight and dimensions of the pump.

Thanks to the invention, this drawback is overcome by the use of a system for driving the piston which ensures a simple longitudinal guiding thereof at the level of its rear part, contrary to the prior art device disclosed by Austrian Patent 314 851 which teaches a very cumbersome guiding by outer slides.

The invention relates to this end to an improvement in variable capacity diaphragm pumps of which the diaphragm limiting a pumping chamber is actuated hydraulically by a liquid contained in a displacement chamber in which a piston animated by a reciprocating movement with fixed stroke moves, said piston being hollow and presenting in the vicinity of the back end radial orifices shut off by an outer ring during part of the stroke and opening into a reserve chamber at atmospheric pressure during another part of the stroke, said piston (6) being driven in a reciprocating movement by a circular eccentric (40) cooperating with two opposite surfaces fast with the piston and perpendicular to its axis.

According to one of the principal features of the invention, said eccentric is fast with the wheel of a speed reducing gear pair constituted by wheel and screw, the eccentric/wheel assembly being mounted so as to rotate idly on a fixed shaft whose axis is perpendicular to the axis of the piston and passes through this axis, said piston terminating in a U-shaped shank of which the wings perpendicular to the axis of the piston and spaced apart by a length slightly greater than the diameter of said eccentric, bear said opposite surfaces, and of which the base is perpendicular to said fixed shaft and is provided with a longitudinal groove parallel to the axis of the piston which is traversed by said fixed shaft, the width of said groove being very slightly greater than the diameter of the fixed shaft.

The invention will be more readily understood on reading the following description with reference to the accompanying drawings, in which.

Figure 1:
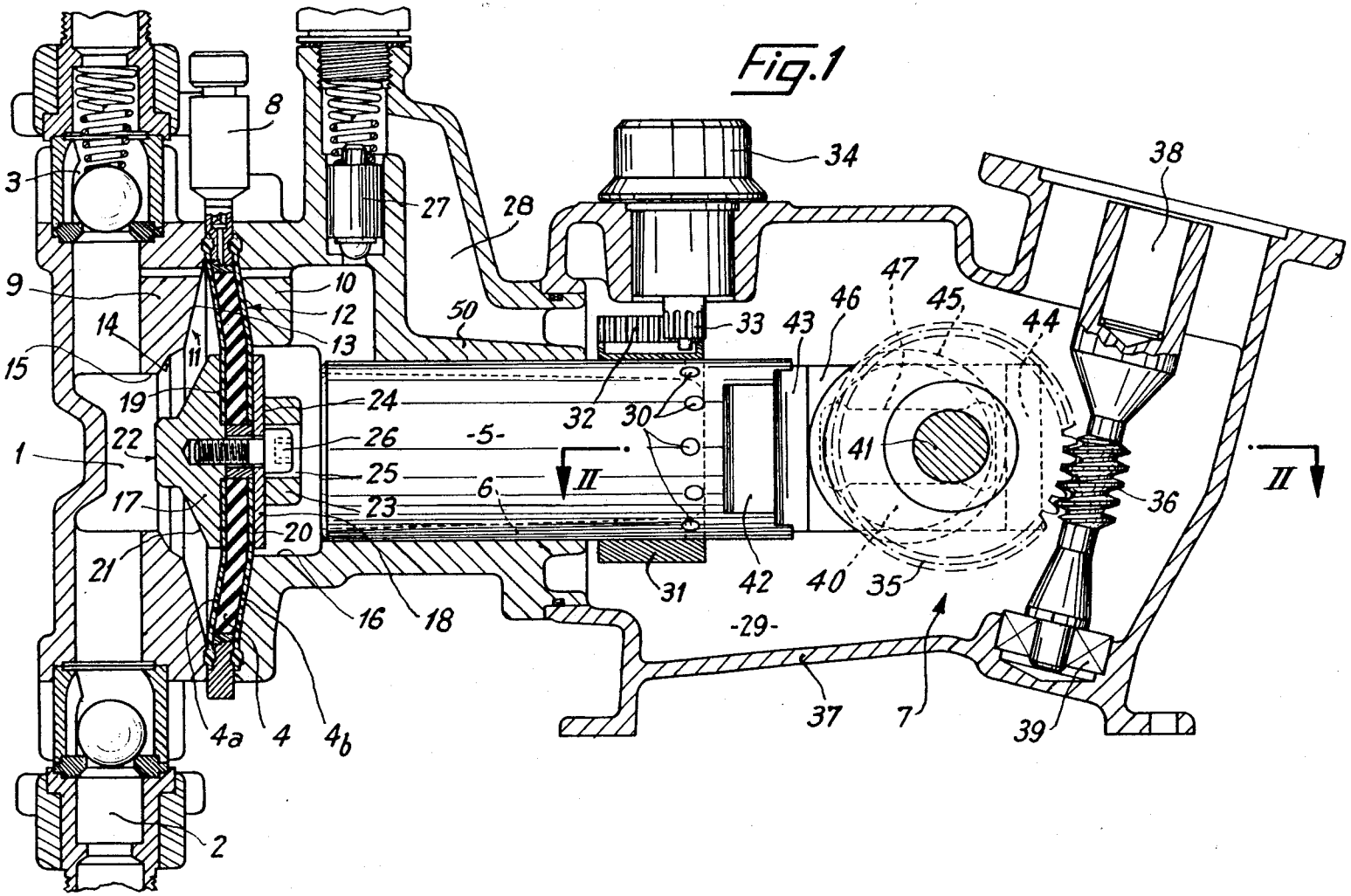
FIG. 1 shows a pump incorporating with improvement according to the invention, in longitudinal section.

Referring now to the drawings, the principle, construction and operation of a variable capacity diaphragm pump of the type shown are known. The conventional elements will simply be described schematically, only the elements of the improvement according to the invention being described in detail. In FIG. 1, the following are successively to be found, from left to right from the front face: the pumping chamber 1 provided with the sucking valve 2 and the forcing valve 3, the diaphragm 4, the displacement chamber 5 housing the hollow piston 6, and the system 7 for driving the piston.

The diaphragm shown is a composite diaphragm formed by a central core made of supple elastomer coated with two thin layers of teflon 4*a* and 4*b*. It is provided with a rupture detector, not shown in detail and referenced schematically at 8. The diaphragm 4 is circular and is maintained on its periphery by being gripped between two rigid stops 9 and 10 disposed respectively in chambers 1 and 5. Each stop 9, 10 is in the form of a ring coaxial to the diaphragm 4, and of which the face 11, 12 turned towards the diaphragm 4 presents a section which is generally conical, widening towards the diaphragm 4. The face 11 of the stop 9 presents a portion of conical section 13 extending radially inwardly from the zone of grip of the diaphragm 4, which continues by a portion 14 of dish section up to the central orifice 15 of the stop 9 in ring form. The orifice 15 preferably has a diameter included between one third and one half of the outer diameter of the stop 9. The face 12 of the stop 10 presents solely a section symmetrical to the section of said portion 13, with respect to the plane of grip of the diaphragm. The face 12 extends radially up to the central orifice 16 of the stop 10, this orifice therefore having a diameter greater than the orifice 15. The orifice 16 is traversed horizontally by a girder 23 abutting on the walls of the orifice and of which the face 24 directed towards diaphram 4 is slightly recessed with respect to the corresponding inlet of the orifice 16. The girder 23 is provided with an axial through hole 25.

On either side of the diaphragm 4, and thereon are fixed two rigid circular deflectors 17, 18 coaxial to the stops 9, 10. Each deflector 17, 18 presents a flat face 19, 20 in contact with the diaphragm 4. The deflector 17 of the pumping chamber 1 presents a conical section 21 complementary of the dish-shaped profile 14 of the stop 9. The deflector 17 terminates at the centre by a cylindrical nose element 22 engaging slightly in the orifice 15. The deflector 18 of the displacement chamber is constituted by a simple flat washer whose diameter is slightly less than that of the orifice 16 of the stop 10 and equal to the outer diameter of the deflector 17. The thickness of the deflector 18 corresponds to the axial shift between the face 24 of the girder 23 facing the diaphragm 4 and the corresponding inlet of the orifice 16 of the stop 10.

The deflectors 17 and 18 are assembled on the diaphragm 4 by means of a screw 26 which abuts on the deflector 18, passes through the latter, the diaphragm 4, and is fixed in the deflector 17. The size of the hole 25 of the girder 23 is sufficient to be able to house the head of the screw 26 therein.

The displacement chamber 5 is provided, in conventional manner, with a safety valve 27 and evacuation thereof is effected through the passage 28 in the reverse chamber 29 which is, in principle, at atmospheric pressure. The hollow piston 6 is provided in its rear part with a plurality of holes 30 adapted to be obturated or opening into the chamber 29 depending on the relative position of the piston and of the adjusting bush 31 mounted in floating manner, with very small clearance, on the piston. The longitudinal position of this bush 31 may be adjusted by means of a rack 32 driven by the pinion 33, itself controlled by the graduated adjusting knob 34. The system of adjustment is set so that, in the front end position of the bush 31 as shown, the holes 30 are covered during the whole stroke of the piston shown here in front end position. This corresponds to zero flow rate of the pump. When the bush is displaced towards the right, the holes 30 are uncovered during part of the stroke, this making it possible to vary the flow rate proportionally to the displacement of the bush 31. The end position which corresponds to about 5/6th of the stroke of the piston must leave the holes uncovered for 1/6th of this stroke to allow the displacement chamber to fill.

Figure 2:
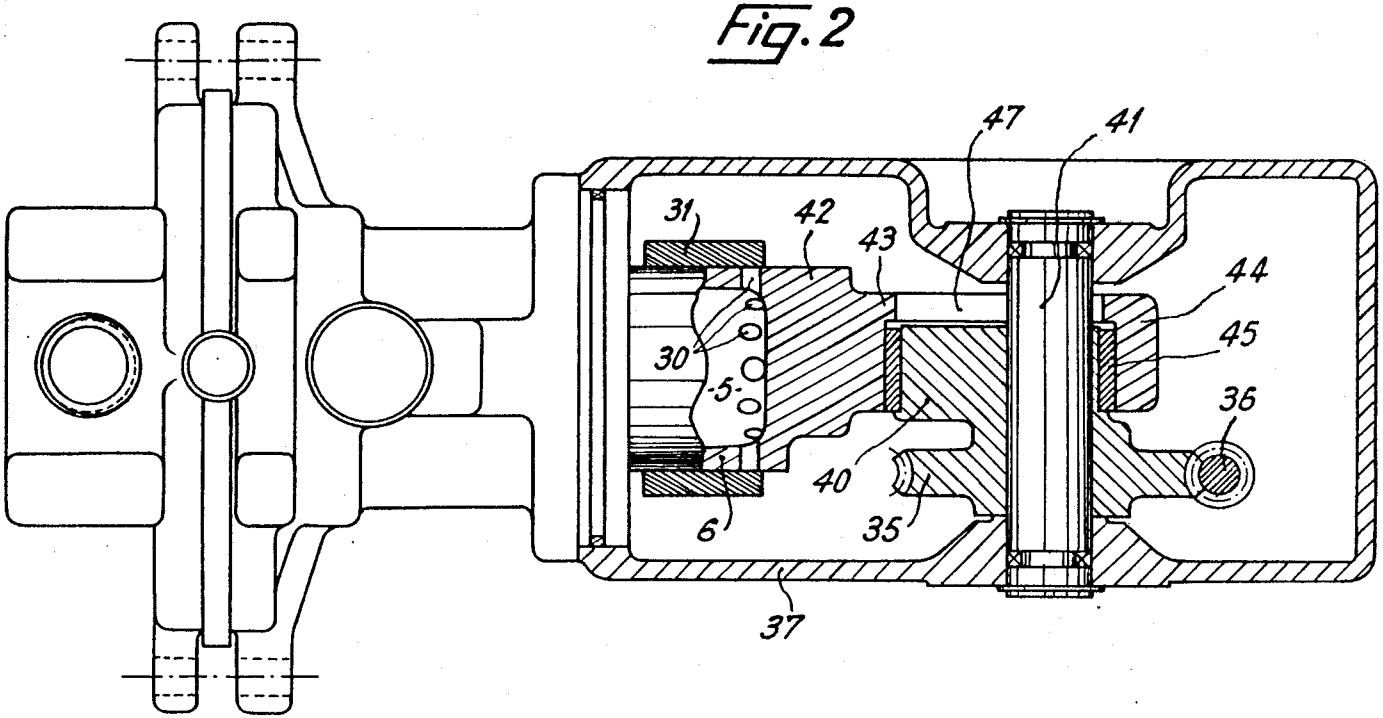
FIG. 2 is a plan view of the pump, in part section along line II—II of FIG. 1.

The control of the piston and guiding thereof will now be described with reference to FIGS. 1 and 2. A speed reducing gear pair incorporating wheel 35 and screw 36 is fixed in the casing 37 of the reserve chamber 29. The screw 36 possesses an axial recess 38 opening out at its upper end, adapted to cooperate with the shaft of a drive motor fixed on the casing 37. The screw 36 rests by its lower end on a thrust bearing 39. The wheel 35 is integral with a circular eccentric 40. This assembly is mounted so as to rotate idly on a fixed shaft 41 whose axis is perpendicular to the axis of the piston 6 and passes through this axis.

The piston 6 presents at its rear end a shank 42 in U-form of which the wings 43, 44 are perpendicular to the axis of the piston 6 and spaced apart by a length very slightly greater then a the diameter of the eccentric 40, the latter being provided with a rotating ring 45 mounted on its bearing surface. The base 46 of the U-shaped shank 42 is perpendicular to the fixed shaft 41 and it is provided with a longitudinal groove 47 parallel to the axis of the piston 6, which is traversed by the fixed shaft 41, the width of the groove 47 being very slightly greater than the diameter of the fixed shaft 41, and its length being sufficient in order not to hinder the movement of the piston.

In operation, when a motor is engaged by its shaft in the recess 38 of the screw 36 of the reduction gear, the wheel 35 and therefore the eccentric 40 rotate about the fixed shaft 41. The eccentric 40 effects a movement with vertical and horizontal components but, thanks to the U-shaped shank 42, it drives the piston 6 only along the horizontal component. The guiding of piston 6 is constantly precise since its shank groove 47 is maintained horizontal by the fixed shaft 41. The combination, in one piece fast with the piston, of the guide groove and of the positive return eccentric drive allows, for the same rigidity, a reduction in length of the front guiding of the piston by sleeve 50, and consequently in the price and weight of the pump with respect to heretofore known systems.

Operation of the pump as a whole is conventional. The movement of the piston is translated by a displacement of the diaphragm producing in the pumping chamber a sweeping equivalent to the useful piston swept volume, i.e. to the volume swept by the piston during that part of the stroke where the holes 30 are obturated. During the period when the holes 30 are uncovered, the displacement chamber 5 is in communication with the reserve chamber 29.

As shown in FIG. 1, the diaphgram 4 is at the end of rearward stroke and it is applied against the stop 10 and, via the deflector 18, against the girder 23. The face 12 of the stop 10 and the face 20 of the deflector 18 constitute a substantially continuous bearing surface for said diaphragm. In the position shown, the other stop 9 defines, in cooperation with the other deflector 17, a wide annular passage promoting flow of the fluid.

When the diaphragm 4 is at the end of forward stroke, it is applied against the stop 9 directly and via the deflector 17 which is housed in the dish 14. The stop face 13 and the face of the deflector 19 constitute a virtually continuous bearing surface for the diaphragm.

The invention is more particularly applicable in the manufacture of variable capacity diaphragm pumps.

What is claimed is:

1. In a variable capacity diaphragm pump in which the diaphragm defining pumping chamber is actuated hydraulically by a liquid contained in a displacement chamber, said variable capacity diaphragm pump comprising:

a piston actuated by reciprocating movement with fixed stroke moves;

said piston having a front end, a back end and an axis, said piston being hollow and presenting in the vicinity of the back end radial orifices;

an outer ring mounted around and adjustably mounted along said back end and being positioned to shut off said radial orifices during part of the stroke, the orifices opening into a reserve chamber at atmospheric pressure during another part of the stroke;

guide means for guiding the front end of said piston over substantially less than the axial length of said piston;

said piston being driven in a reciprocating movement by a circular eccentric cooperating with two opposed surfaces secured to said piston;

said eccentric being integral with the gear of a speed reducing gear pair defining an eccentric/wheel assembly;

the reducing gear pair including a gear and screw;

a stationary shaft perpendicular to and having an axis passing through the axis of said piston, said eccentric/wheel assembly being mounted on said shaft to rotate thereon;

said piston terminating in an integral U-shaped shank spaced axially outwardly of said radial orifices;

said shank defining a pair of wings having said opposed surfaces on which said eccentric bears, said opposed surfaces being perpendicular to and spaced apart axially along the piston axis, said opposed surfaces being spaced apart by a length slightly greater than the diameter of said eccentric;

said shank including a base extending between said wings and perpendicular to said fixed shaft;

said base having a longitudinal groove parallel to the axis of said piston;

said stationary shaft extending through said groove, said groove having a width slightly greater than the diameter of said stationary shaft to permit free axial movement of said piston relative to said stationary shaft; and said groove and said stationary shaft supporting and guiding the back end of said piston to provide reduced length of said guide means for the front end of said piston and to minimize forces on said piston in a direction transverse to the piston axis.

* * * * *

UNITED STATES PATENT AND TRADEMARK OFFICE

CERTIFICATE OF CORRECTION

PATENT NO. : 4,883,412

DATED : November 28, 1989

INVENTOR(S) : Max A. Malizard, Jean C. Degremont

It is certified that error appears in the above-identified patent and that said Letters Patent is hereby corrected as shown below:

Column 3, line 15, delete "reverse" and insert therefore -- reserve --.

Signed and Sealed this

Twenty-second Day of January, 1991

*Attest:*

HARRY F. MANBECK, JR.

*Attesting Officer*

*Commissioner of Patents and Trademarks*